US006663264B2

(12) United States Patent
Gelfand et al.

(10) Patent No.: US 6,663,264 B2
(45) Date of Patent: Dec. 16, 2003

(54) LAMP ASSEMBLY WITH VENTILATION SYSTEM

(75) Inventors: Anatoly Gelfand, West Bloomfield, MI (US); Joseph William Bielecki, Clinton Township, MI (US)

(73) Assignee: North American Lighting, Inc., Farmington Hills, MI (US)

( * ) Notice: Subject to any disclaimer, the term of this patent is extended or adjusted under 35 U.S.C. 154(b) by 149 days.

(21) Appl. No.: 09/854,819

(22) Filed: May 14, 2001

(65) Prior Publication Data

US 2002/0167810 A1 Nov. 14, 2002

(51) Int. Cl.[7] ..... F21V 29/00
(52) U.S. Cl. ..... 362/373; 362/547
(58) Field of Search ..... 362/96, 255, 294, 362/373, 539, 546, 547, 351

(56) References Cited

U.S. PATENT DOCUMENTS

| | | | | | |
|---|---|---|---|---|---|
| 4,025,779 | A | * | 5/1977 | Ahroni | 362/294 |
| 4,569,007 | A | | 2/1986 | Dick | 362/294 |
| 4,739,458 | A | | 4/1988 | Yamayoshi et al. | 362/294 |
| 4,814,959 | A | * | 3/1989 | Chakrabarti et al. | 362/345 |
| 4,885,668 | A | * | 12/1989 | Maglica et al. | 362/294 |
| 4,931,912 | A | | 6/1990 | Kawakami et al. | 362/61 |
| 5,010,453 | A | | 4/1991 | Ketterman | 362/61 |
| 5,367,438 | A | | 11/1994 | Deslandres | 362/61 |
| 5,457,616 | A | | 10/1995 | Grigorescu et al. | 362/294 |
| 5,510,968 | A | * | 4/1996 | Pokriefka et al. | 362/294 |
| 5,758,957 | A | | 6/1998 | Perrotin | 362/294 |
| 5,833,356 | A | | 11/1998 | Yamamoto et al. | 362/294 |
| 6,045,248 | A | | 4/2000 | Ashizawa | 362/547 |
| 6,203,177 | B1 | * | 3/2001 | Watanabe et al. | 362/539 |

* cited by examiner

*Primary Examiner*—Y. My Quach-Lee
(74) *Attorney, Agent, or Firm*—McDonnell Boehnen Hulbert & Berghoff

(57) ABSTRACT

A lamp assembly having a lamp housing defining a cavity with at least one side. The at least one side has vent passage. A heat shield is coupled to at least one side and at least partially aligned with the vent passage to provide ventilation to the lamp housing.

21 Claims, 1 Drawing Sheet

LAMP ASSEMBLY WITH VENTILATION SYSTEM

FIELD OF INVENTION

The present invention relates to a ventilation system for a lamp assembly, such as an automotive headlamp, fog lamp, signal light, or taillight. More specifically, it relates to a lamp assembly having an optical and/or non-optical shield coupled to a ventilation air passage, such that a cavity of the lamp assembly may be ventilated to an ambient environment.

BACKGROUND OF THE INVENTION

A concern that frequently arises during the design of automotive lighting devices is the need to provide proper ventilation for an interior of a housing or body of the lighting device. While adequate ventilation is important for both lighting device functionality and appearance, the automotive lighting device design should also take into account the prevention of fogging of the lighting device lens. Device design should also take into account the unwanted penetration of water, dirt, dust and other contaminants from a surrounding ambient into the lighting device cavity. These design concerns can be especially important where the lighting device resides on the exterior of an automobile that is subject to high speeds, inclement weather, and high water pressure situations (e.g., a car wash).

Such design concerns also arise when designing an optical and/or non-optical lighting device to ventilate internally generated heat. For example, during use, a bulb of a typical lamp reaches relatively high temperatures. Heat transferred from the bulb can melt, deform, or otherwise damage the lamp housing surrounding the bulb, especially when the lamp housing is made from an inexpensive plastic material. While any side of the lamp housing may have one or more areas susceptible to heat damage, the top side of the lamp housing above the bulb generally suffers the greatest damage due to heat transfer by free, or natural, convection from the bulb.

A known method of ventilating lighting devices is to provide the lighting device with a system of chicanes, labyrinths or air ducts that create a tortuous path. Such a known device is disclosed in U.S. Pat. No. 5,758,957 to Perrotin which is herein incorporated by reference and to which the reader is directed for further details. In this known device, a labyrinth path is provided. This path is an air passage provided with a number of angles. This labyrinth passage deters ingress of moisture and dust but, at the same time, allows air transfer between the lamp and the environment to equalize pressure and, if applicable, transfer heat. In other words, this allows the lamp to "breathe" while also reducing the potential for fogging and condensation.

Such known lighting devices have a number of manufacturing and design disadvantages. For example, where the lighting device is an injection molded device, creating a torturous path in an injection molded part may be difficult. Creating a passage of two complete or more 90° turns with a single tool injection molded component creates manufacturing complexities because it requires more than one die draw direction.

Other known ventilation designs utilize additional rubber parts to provide a torturous path, such as a macaroni tube, that attaches snuggly to a vent boss on the housing. The addition of a number of rubber parts also add cost in the form of material, assembly time, and warranty/quality because these vents often fall off or are forgotten. Extra lamp device pieces also increase the overall weight of the device.

Accordingly, it would be desirable to have a lighting device ventilation system that overcomes the problems associated with known systems.

There is a general need for reducing the cost of a lighting device system. There is also a need for a vent system that does not require a macaroni or other angled tube. There is a further need for combining lamp components while also reducing the complexity of molding tools.

SUMMARY OF THE INVENTION

The present invention provides a lamp assembly including a lamp housing defining a cavity. The lamp housing has at least one side with a vent passage. A heat shield is coupled to at least one side and at least partially aligned with the vent passage to provide ventilation to the lamp housing.

In another embodiment, a vehicle lighting device includes a lamp housing defining a cavity. The lamp housing has at least one side provided with a ventilation opening. A bulb shield insert that has an attachment mechanism is at least partially aligned with the ventilation opening. The attachment mechanism at least partially allows for ventilation of the cavity. A bulb shield stem extends from the bulb shield insert. The bulb shield stem has a bulb shield cover adapted to at least partially cover a bulb.

A method for ventilating a lamp assembly is also disclosed. The method includes defining an internal cavity of a lamp housing. A vent passage is provided in a side of the lamp housing. A heat shield is coupled to the at least one side; and at least partially aligning the heat shield with the vent passage to provide ventilation to the lamp housing.

DETAILED DESCRIPTION OF PREFERRED EMBODIMENTS

Figure 1:
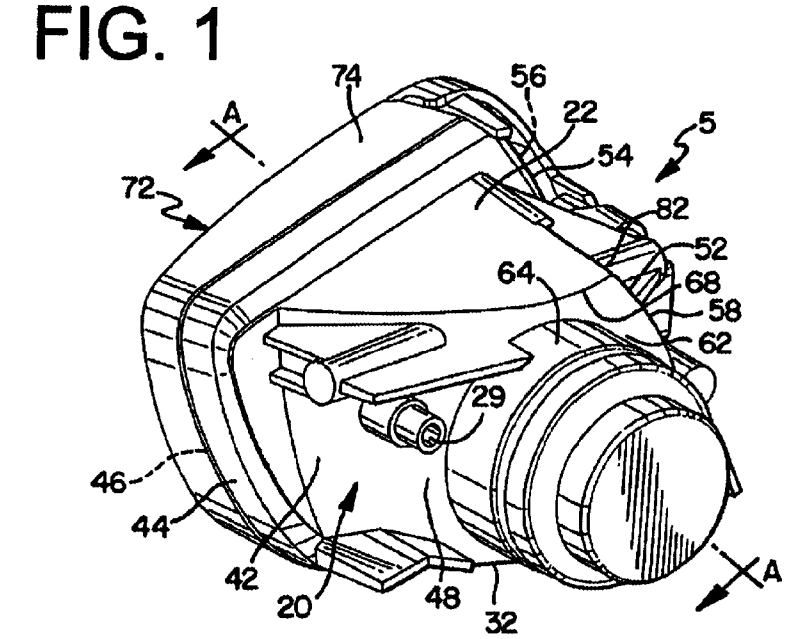
FIG. 1 is a back perspective view of a preferred embodiment of a lamp assembly illustrating one aspect of the present invention.
Figure 2:
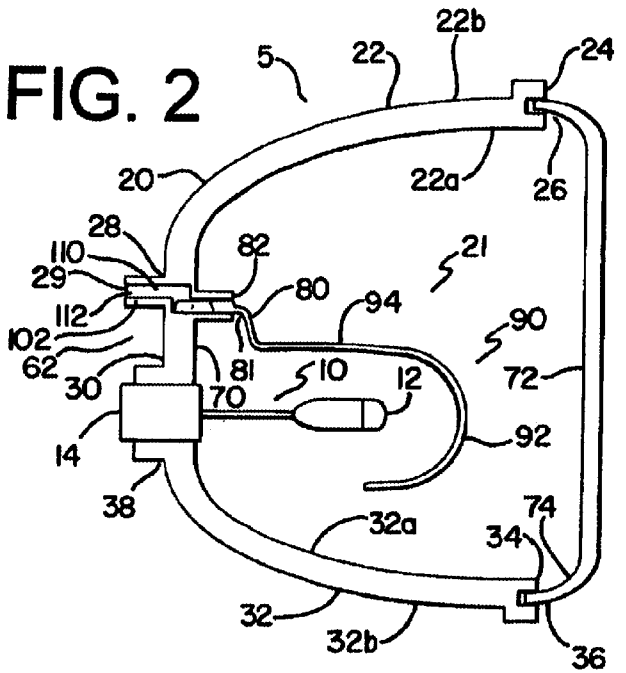
FIG. 2 is a cross-sectional view of the lamp assembly of FIG. 1 taken along line A—A.

Turning now to the drawings, FIGS. 1–2 show a preferred embodiment of a lamp assembly 5 of the present invention. The lamp assembly 5 comprises a lamp bulb 10, a lamp housing 20, a lens 72, and a bulb shield 90. The bulb shield 90 has a bulb shield insert 80 that acts as an engagement mechanism and is preferably spring compression engaged into a vent passage 29.

The lamp bulb 10 has a light and heat generating filament portion 12, and a socket 14 opposite the filament portion. It should be understood, however, that the socket 14 may be an integral component of the lamp bulb 10, or alternatively, may be a separate component connected to the lamb bulb 10. Although an incandescent bulb is shown in FIG. 1, it should also be understood that any desirable type of lamp bulb may be used with the lamp assembly of the present invention, depending upon regulatory, manufacturing, and/or consumer preferences.

As shown in FIG. 2, the lamp housing 20 defines a cavity 21. Preferably, but not necessarily, the lamp housing 20 is made from a plastic, such as polycarbonate or ABS.

The lamp housing 20 also has a top side 22 with an interior surface 22*a* facing the cavity 21, and an exterior surface 22*b* opposite the interior surface 22*a*. The top side 22 also has a front end 24 with a lens slot 26, and a second end 28. The second end 28 and a back portion 30 of the lamp housing 20 partially define a vent passage 29.

The vent passage 29 is preferably located in the back portion 30 and adjacent the socket 14, because an energized light bulb heats and forces the air upward in the center of the lamp. The hotter the air, the higher the amount water vapor the air can potentially hold. Egressing as much of this hot, potentially moist, air as possible is advantageous. It should be understood, however, that the vent passage may be located elsewhere within the lamp housing (i.e., another side or beneath the socket 14). Other locations will depend on the configuration of the lamp assembly. The vent passage 29 provides an outlet for releasing excess fluids, heat, and/or pressure within the cavity 21 of the lamp housing 20. The vent passage 29 also reduces the amount of fluids, dirt, etc. entering the cavity. As will be detailed below, the vent passage also serves to provide a coupling means for a bulb shield.

The lamp housing 20 also has a bottom side 32 with an interior surface 32*a* facing the cavity 21, and an exterior surface 32*b* opposite the interior surface 22*a*. The bottom side 32 also has a front end 34 with a lens slot 36, and a second end 38. The second end 38 partially defines a bulb socket aperture with the back portion 30 of the lamp housing 20.

The lamp housing 20 also has a first side 42 and a second side 52 spaced from the first side. The first and second sides 42, 52 connect the top side 22 to the bottom side 32, and may be curved, as shown in FIG. 1. Like the top side 22 and the bottom side 32, the first side 42 and the second side 52 each have a first end 44, 54 with a lens slot 46, 56, and a second end 48, 58, respectively.

The lamp housing 20 further includes a back side 62. The back side 62 has a first end 64 and a second end 68 connected to the second ends 28, 38, 48, 58 of the top, bottom, first and second sides 22, 32, 42, 52. The bulb socket 14 is adapted to receive and hold the socket 4 of the lamp bulb 10. Preferably, the back side 62 is at least partially curved and has a reflective inner surface 70 for reflecting and imaging emitted light from the lamp bulb 10 forward away from the back side 62.

In addition, the top, bottom, first, second and back sides 22, 32, 42, 52, 62 are preferably formed integral with one another. For instance, injection molding may be used to form the top, bottom, first, second, and back sides 22, 32, 42, 52, 62.

As shown in FIG. 2, the bulb shield 90 comprises a bulb shield cover 92, a bulb shield stem 94, and a bulb shield insert 80. The bulb shield insert 80 is preferably removably attached to the vent passage 29. In the preferred embodiment shown in FIG. 2, the vent passage 29 is defined at least partially by second end 28 of the top side 22 and at least partially by a top portion 102 of back portion 30 and the bulb shield insert 80 may be spring compression engaged in the vent passage 29. It will be understood that other types of engaging devices may also be used to removably attach the insert 80 into the vent passage. Other attachment designs include those that produce pressure on the vent walls for rigidity, snap fit designs, or those that may require a separate fastener. Alternatively, a fixedly attached engaging device may be used.

In the embodiment illustrated in FIGS. 1 and 2, the bulb shield insert 80 includes an attachment mechanism 81. In one preferred embodiment, the attachment mechanism 81 is a spring. The configuration of the attachment mechanism 81 allows the bulb shield to be removably inserted into the vent passage 29 while simultaneously allowing air flow through the vent passage 29. Because the insert and in particular the attachment mechanism 81 does not completely obstruct the air passage, the configuration of the attachment mechanism 81 enables air flow between the cavity 21 and the exterior of the lamp assembly 5 thereby providing ventilation to the lamp assembly.

Preferably, the shape and size of the attachment mechanism 81 is configured to generally match the shape and size of a vent passage opening 82. The attachment mechanism 81 is preferably made from steel. Alternatively, attachment mechanisms may be made from other materials, such as aluminum or copper, that can generally withstand relatively high temperatures. Since the vent passage opening 82 may be located within one of the other lamp assembly 5 sides (i.e., bottom side 32, first side 42, or second side 52), and the attachment mechanism 81 is mounted in the vent passage opening 82, it should be understood that the attachment mechanism 81 may also be mounted on one of the other sides, and hence the bulb shield 90 may be engaged in other sides of the lamp assembly, such as for example in the first side 42 (i.e., a side surface). In addition, it should be further understood that with the lens 72 and the attachment mechanism 81 being connected and mounted to the lamp housing 20, and without any further requirement for vent holes, the lens 72, the attachment mechanism 81, and the lamp housing 20 together form a sealed lamp assembly 5.

FIG. 2 also shows that the vent passage 29 has an inner vent passage opening 112 along with the vent passage opening 82. A labyrinth path 110 is defined through both of the openings 82 and 112.

Figure 3:
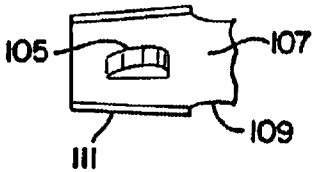
FIG. 3 is a perspective view of one embodiment of a bulb shield attachment stem.

FIG. 3 is a perspective view of a first embodiment of the bulb shield attachment mechanism 100 of the bulb shield 90 of the present invention. As seen from FIG. 3, the mechanism 100 includes a top surface 107 and a bottom surface 109. A spring 105 is provided along the top surface 107. In this embodiment, the spring 105 resides along a center portion of the spring top surface 107. The spring 105 resides along the top surface of the mechanism however it will be generally understood that other configurations are possible. For example, the bulb shield attachment mechanism 100 could include multiple springs, different spring locations, etc.

The bulb shield attachment mechanism 100 also has a width and preferably this width is non-uniform. Such a non-uniform width may be tapered into a configuration such that it has a dimension that is slightly smaller than an inner width of the vent passage (See FIG. 2). With such a tapered configuration, when the attachment mechanism is coupled to the vent passage, the non uniform width compression engages the vent passage inner walls and becomes removably or fixedly attached.

A ridge 111 is also provided along an edge of the insert. This ridge reinforces the structure of the attached mechanism.

As the attachment mechanism 100 is inserted into a lamp assembly vent passage, and depending on the spring configuration, the spring 105 may become compressed by either a vent passage top wall, a vent passage bottom wall, or alternatively a vent passage side wall. The compressed spring then attaches the attachment stem within the vent passage. Importantly, the spring configuration allows air flow between the lamp assembly cavity and ambient.

Returning to FIGS. 1–2, the lamp assembly 5 comprises a bulb shield 90 with a cover 92 and a bulb shield stem 94. The cover 92 is adapted and designed to at least partially cover the filament portion 12 of the lamp bulb 10. The stem 94 is connected to both the cover 92 and the bulb shield insert 80 which is connected to the attachment mechanism 81, thereby providing a conduit for heat to be transferred from the bulb shield 90 to the attachment mechanism 81. Preferably, but not necessarily, both the cover 92 and the stem 94 are made from steel. Alternatively, the cover 92 and/or the stem 94 of the bulb shield 90 may be made from other materials, such as aluminum or copper.

Figure 6:
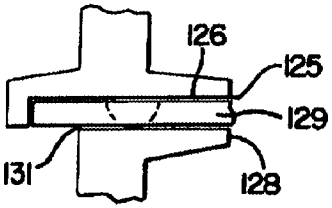
FIG. 6 is a side view of yet another embodiment of the bulb shield attachment stem illustrated in FIG. 3.
Figure 5:
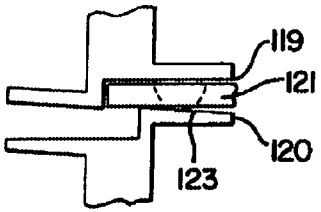
FIG. 5 is a side view of a second embodiment of the bulb shield attachment stem illustrated in FIG. 3.
Figure 4:
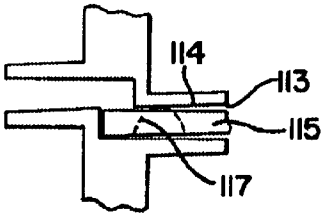
FIG. 4 is a side view of a first embodiment of the bulb shield attachment stem illustrated in FIG. 3.

FIGS. 4–6 show alternative embodiments of the attachment mechanism and vent passages of the present invention. The vent passages illustrated in FIGS. 4–6 operate in the same manner as, the vent passage 90 shown in FIGS. 1–2, with certain slight structural differences.

For example, as can be seen from FIG. 4, an attachment mechanism 115 is operatively coupled to a vent passage 113. The attachment mechanism 115 includes a spring 117 which compressionly engages a top portion 114 of the passage 113.

FIG. 5 includes an attachment mechanism 121 coupled to a vent passage 119. The attachment mechanism 121 includes a spring 123 which compression engages a bottom portion 120 of the passage 119. And in FIG. 6, an attachment mechanism 129 is shown coupled to a vent passage 125. The attachment mechanism 129 includes a spring 131 which compression engages a bottom portion 128 of the passage 125.

One difference between the vent passage 125 of FIG. 6 and the vent passage of FIG. 4 is that vent passage 125 is not a stepped passage. Rather, passage 125 is a linear passage having a generally smooth top portion and a smooth bottom portion 128. In this embodiment, a spring lever engages a bottom reflector wall rather than a top reflector wall. Alternatively, the attachment spring could engage a top portion of the passage.

While the lamp assemblies of the present invention may be applied with particular advantage to head lamps, fog lamps, signal lights, and/or taillights of automotive vehicles, the lamp assemblies of the present invention may also be used with other lamps and lights for automotive vehicles, or with lamps and lights unrelated to automotive vehicles. It should also be readily apparent from the foregoing description and accompanying drawings that the lamp assemblies of the present invention are improvements over the prior art. In particular, the lamp assemblies of the present invention allow the vent to be concealed from observation through the lens of the lamp and reduce cost by combining the shield attachment slot with the vent hole.

Those skilled in the art to which the invention pertains may make modifications and other embodiments employing the principles of this invention without departing from its spirit or essential characteristics, particularly considering the foregoing teachings. Accordingly, the described embodiments are to be considered in all respects only as illustrative and not restrictive, and the scope of the invention is, therefore, indicated by the appended claims rather than by the foregoing description. Consequently, while the invention has been described with reference to particular embodiments, modifications of structure, sequence, materials, and the like would be apparent to those skilled in the art, yet would still fall within the scope of the invention.

What is claimed is:

1. A lamp assembly comprising:

a lamp housing defining a cavity, the lamp housing having at least one side with a vent passage; and a heat shield coupled to the at least one side and at least partially aligned with the vent passage to provide ventilation to the lamp housing, wherein the heat shield frictionally mates with the vent passage.

2. The lamp assembly of claim 1 wherein the heat shield is removably attached to at least one side.

3. The lamp assembly of claim 1 wherein the heat shield is at least partially inserted into the vent passage.

4. The lamp assembly of claim 1 wherein the vent passage defines a labyrinth path.

5. The lamp assembly of claim 1 wherein the vent passage is defined by a top portion and a back portion of the lamp housing.

6. The clamp assembly of claim 1 wherein the heat shield frictionally mates to a bottom portion of the vent passage lamp housing bottom portion.

7. The lamp assembly of claim 1 wherein the at least one side of the lamp housing is a lamp housing back side.

8. The lamp assembly of claim 1 wherein at least a portion of the at least one side has a reflective inner surface.

9. The lamp assembly of claim 1 wherein the heat shield is provided with a spring.

10. The lamp assembly of claim 1 wherein the heat shield engages either a top surface or a bottom surface of the vent passage.

11. The lamp assembly of claim 1 wherein the heat shield engages a side surface of the vent passage.

12. The lamp assembly of claim 1 wherein the heat shield is made from one of steel, aluminum, and copper.

13. A vehicle lighting device comprising:

a lamp housing defining a cavity, the lamp housing having at least one side provided with a ventilation opening;

a bulb shield insert having an attachment mechanism, the bulb shield insert positioned in the lamp housing such that the attachment mechanism is at least partially aligned with the ventilation opening, the attachment mechanism allowing ventilation of the cavity; and a bulb shield stem extending from the bulb shield insert, the bulb shield stem having a bulb shield cover adapted to at least partially cover a bulb.

14. The lighting device of claim 13 wherein the lamp housing is a multi-component injection molded device.

15. The lighting device of claim 13 wherein the at least one side of the lamp housing is a back side.

16. The lamp assembly of claim 15 wherein the back side is adapted to receive the bulb.

17. The lamp assembly of claim 15 wherein at least a portion of the back side has a reflective inner surface.

18. The lamp assembly of claim 13 wherein the bulb shield insert, the stem, and the cover are formed integral with one another.

19. The lamp assembly of claim 13 wherein the bulb shield insert is made from steel.

20. A method for ventilating a lamp assembly comprising the steps of:

defining an internal cavity of a lamp housing;

providing a vent passage in a side of the lamp housing;

frictionally coupling a heat shield to at least the side; and at least partially aligning the heat shield with the vent passage to provide ventilation to the lamp housing.

21. A lamp assembly comprising:

a bulb having a filament portion and a socket opposite the filament portion;

a lamp housing having a back side with an exterior surface, a bulb opening, and a ventilation opening, the bulb opening aligned with the filament portion of the bulb;

a heat shield plate frictionally mounted within the ventilation opening on the back side to transfer heat away from the lamp housing.

* * * * *